United States Patent [19]

Becker et al.

[11] Patent Number: 4,667,895

[45] Date of Patent: May 26, 1987

[54] LAP CREEL

[76] Inventors: Josef Becker; Hubert Becker; Matthias Becker, all of Niederforstbacher Str. 80-84, 5100 Aachen-Brand, Fed. Rep. of Germany

[21] Appl. No.: 886,793

[22] Filed: Jul. 16, 1986

[30] Foreign Application Priority Data

Jul. 16, 1985 [DE] Fed. Rep. of Germany ..... 3525311

[51] Int. Cl.[4] ..... B65H 75/20

[52] U.S. Cl. ..... 242/118.1; 68/198; 242/118.3

[58] Field of Search ..... 242/118.1, 118.11, 118.2, 242/118.3, 118.31, 118.32, 118; 68/189, 198

[56] References Cited

U.S. PATENT DOCUMENTS

| | | | |
|---|---|---|---|
| 2,489,465 | 11/1949 | Russell | 242/118.1 X |
| 3,675,871 | 7/1972 | Heyden | 242/118.3 |
| 4,074,875 | 2/1978 | Fratturo | 242/118.3 |
| 4,078,740 | 3/1978 | Hahm et al. | 242/118.11 |
| 4,176,811 | 12/1979 | Becker et al. | 242/118.1 |
| 4,180,219 | 12/1979 | Becker et al. | 242/118.1 |
| 4,209,143 | 6/1980 | Hahm et al. | 242/118.11 |
| 4,272,037 | 6/1981 | Becker et al. | 242/118.1 |
| 4,491,286 | 1/1985 | Nielsen | 242/118.11 |
| 4,519,557 | 5/1985 | Newman | 242/118.3 X |

FOREIGN PATENT DOCUMENTS

| | | | |
|---|---|---|---|
| 1085398 | 7/1954 | France | 242/118.1 |
| 1094379 | 12/1954 | France | 242/118.1 |
| 1492546 | 7/1967 | France | 242/118.1 |
| 968983 | 9/1964 | United Kingdom | 242/118.1 |

*Primary Examiner*—Stanley N. Gilreath

*Attorney, Agent, or Firm*—W. G. Fasse; D. H. Kane, Jr.

[57] ABSTRACT

Axially extending ribs (7,8) are evenly distributed around the circular circumference of a lap creel. Upper ribs (7) protrude radially outwardly from the outer surface of a shell (5) of the lap creel in an upper carrying portion (1). Lower ribs (8) protrude radially inwardly from the inner surface of the shell (5) in a lower carrying portion (2). The radius of the upper carrying portion (1) is smaller than the radius of the lower carrying portion (2). Radially outer limiting surfaces (9) of the upper ribs (7) have a smaller radius than the inner radius of the shell (5) in the lower carrying portion (2). The radially inner limiting surfaces (10) of the lower ribs (8) have a radius which is larger than the outer radius of the shell (5) in the upper carrying portion (1). The limiting surfaces (9) of the upper ribs (7) have a larger radius than the radius of the limiting surfaces (10) of the lower ribs (8). Nesting of a plurality of creels is substantially facilitated and the quantity of material for casting these creels in a mold is substantially reduced, yet the resulting light-weight structure has substantial strength.

10 Claims, 7 Drawing Figures

LAP CREEL

FIELD OF THE INVENTION

The invention relates to a lap creel having axially directed ribs or fins distributed evenly over the circular circumference of the lap creel. These ribs extend along an upper carrying zone of smaller radius and along a lower carrying zone of larger radius of the lap creel.

DESCRIPTION OF THE PRIOR ART

Such known lap creels may be coaxially stacked or at least partially inserted into one another to a defined depth due to the various zones of different diameters of the lap creel. The lap creels may be coaxially stacked in this manner even if they are wound with yarn or thread. Thus, it is possible to axially compress the yarn or thread on the spools so that a plurality of coaxially arranged yarn spools may be compressed into a homogenous column of yarn.

The German Patent Publication DE-PS No. 2,452,127, corresponding to U.S. Pat. No. 4,078,740, discloses a lap creel with carrying members extending in parallel to the axis of the creel. The carrying members lie on a circular cylindrical surface and are only secured by one end ring. The end ring has slots which are larger than the cross-section of the carrying members. The carrying members are additionally attached to at least one support ring at their ends opposite the end ring. The support ring is attached to the radially inner surface of each of the carrying members.

In order to coaxially insert this known lap creel of German Patent Publication No. 2,452,127 into a lap creel of similar construction, it must have carrying members with radial support surfaces forming a contact surface for the yarn and defined by a circular cylindrical surface. The necessarily cylindrical winding surface has the disadvantage that wound-on yarn, or at least several turns of yarn, may easily accidentally slide off the creel and may not or cannot be pushed back onto the creel. Another disadvantage is seen in that during unwinding yarn from such a cylindrical lap creel, the last turns of yarn have a tendency to be pulled off simultaneously and together with the thread running in the axial direction of the lap creel. These last turns are then no longer usable for further processing. A further disadvantage of this known lap creel is that the end ring protrudes radially outwardly beyond the cylindrical winding surface thereby hindering the formation of a freely accessible thread reserve, such a so-called thread reserve serves to connect the end of one yarn to the beginning of a next yarn on successive lap creels. Furthermore, the slots in the end ring greatly reduce the stability of the entire lap creel.

A lap creel disclosed in German Patent Publication DE-PS No. 2,845,053 similarly comprises rod-shaped carrying members extending in an axial direction. These axial carrying members form a circular cage with ring-shaped support elements. However, this lap creel does not exhibit the above mentioned disadvantages because the outer surfaces of the rod-shaped carrying members lie on a bi-conical shell surface with a common smaller base circle, whereby the common base circle is located in the middle zone of the lap creel.

A lap creel having conically extending carrying members or ribs is disclosed in German Patent Publication DE-PS No. 2,730,876, corresponding to U.S. Pat. No. 4,180,219 (Becker et al), wherein the carrying members protrude radially outwardly in an upper region and radially inwardly in a lower region. Due to the conical arrangement of the carrying members or ribs throughout, a separation of the lap creel into an upper and a lower carrying zone is not defined. Further, due to the conical outer shape defined by the ribs, it can happen that creels nested one within the other stick together too strongly.

U.S. Pat. No. 4,176,811 discloses a lap creel having straight ribs combined with an upper and a lower conical body section. The upper conical body section has a smaller diameter than the lower conical body section. The ribs extend radially inwardly and outwardly in the upper body section and radially inwardly in the lower body section. However, the creel remains conical along its entire length and hence requires a stop ring for preventing the too forceful sticking of one creel within another.

All previously known lap creels have the common disadvantage that the carrying members and fixing members must have relatively thick cross-sections and must be relatively closely spaced, in order to achieve a sufficient strength and stability of the lap creel. This leads to a complicated structure and a substantial material expenditure for the lap creels, which are normally made of synthetics.

A further disadvantage of the known lap creels is that any rod-shaped carrying members or ribs, which project beyond the height of the lap creel, hinder the winding process because a friction roller for driving the lap creel only contacts a smooth cylindrical surface after the first courses or turns of yarn have been wound onto the creel so that the spaces between neighboring carrying members are bridged. Until then, the friction roller suffers from a chatter effect. The extent of this chatter effect depends on the size of the gap between neighboring carrying members. However, this gap spacing cannot be made smaller as desired because the gaps between carrying members serve the function of passages for a flowing treating medium which must freely flow through the creels.

OBJECTS OF THE INVENTION

In view of the foregoing it is the aim of the invention to achieve the following objects singly or in combination:

to provide a lap creel which may be coaxially inserted to a certain extent into another lap creel of similar construction without getting stuck;

to achieve high strength and form stability in such a lap creel with a simple, light structure requiring a low material expenditure;

to provide gaps or channels and free space passages of a size sufficient for a free treating medium flow, while at the same time providing a surface for a smooth friction roller contact in such a lap creel;

to insure a trouble-free winding-on of yarn onto such a lap creel from beginning to end;

to allow the easy formation of a freely accessible thread reserve on such a lap creel;

to prevent the last turns or courses of wound-on yarn from simultaneously being pulled as a clump from such a lap creel during unspooling for a trouble-free unspooling operation; and to prevent accidental end run-off or shifting of yarn turns during winding, and to also prevent the wound-on yarn from shifting in an unintended manner or accidentally sliding off such a lap creel.

SUMMARY OF THE INVENTION

The above objects have been achieved in a lap creel according to the invention comprising the following features. Axially extending ribs or fins are evenly distributed around the circular circumference of the lap creel. A creel cage or body has an upper carrying body or cage portion with a smaller radius and a lower carrying body or cage portion with a larger radius. The cage is formed by a shell which is essentially solid, except for radial holes, and extends through both carrying zones to intersect the path of the ribs which protrude radially outwardly on the outside of the upper portion and radially inwardly on the inside of the lower cage portion. The radially outwardly protruding ribs on the outer surface of the shell have an outer radial limit surface with a radius which is smaller than the radius of the inner surface of the shell of the lower cage portion. The ribs or fins protruding radially inwardly from the inner surface of the shell of the lower cage portion comprise a radially inner limit surface with a radius which is larger than the radius of the outer surface of the shell of the upper cage portion.

According to the invention a rather rigid, yet lightweight creel results because of the continuous shell, which extends around the complete circumference and along the entire length of the lap creel and which is essentially solid except for the radial holes. Such a cage structure is very strong and stable even with a relatively thin wall thickness of the shell. The lap creel is especially sturdy in a radial direction to resist radially inwardly directed compressive forces.

The use of such a shell, which is essentially continuous except for the radial holes, greatly simplifies the mold for making the present lap creel as compared to a mold needed for making a creel having separate rings and rod-like carrier members, whereby the manufacture of such creels of plastic or other synthetics is greatly simplified. The rib portions, which only protrude radially outwardly along the upper carrying portion, are easily shaped so that the radii of the outer limiting surfaces of the ribs decrease slightly in a direction toward the lower carrying portion. Thus, these limiting surfaces together form a conical winding contact surface which becomes wider toward the upper end of the spool. This feature makes sure that during the unwinding process the last remaining courses or turns of thread or yarn are prevented from being pulled simultaneously off the end of the creel by the thread unwinding tension.

Because the ribs only project radially outwardly from the shell along the length of the upper carrying portion and project radially inwardly along the length of the inner surface of the lower carrying portion of the shell, an essentially smooth outer shell surface is achieved along the lower portion with the exception of the, for example circular, radial holes in the shell. A friction roller for driving the lap creel may be pressed against this essentially smooth surface of the lower shell portion, so as to achieve a smooth drive for the winding process without subjecting the friction roller to a chatter effect. The diameter of the holes in the shell is considerably smaller than the width of the typical friction roller. The friction roller makes a substantially continuous contact with the rotating lap creel even before the first thread courses are wound onto the creel.

The circumferentially continuous contact of the first course of thread wound onto the lower carrying zone ensures a sufficient adhesion to prevent these last-unwound courses of thread from simultaneously slipping off the creel during the unwinding process. Furthermore, the structure of the lower carrying portion without any carrying members or ribs projecting radially outwardly from the shell, allows the formation of a freely accessible thread reserve for tying the thread end of one lap creel early to the thread beginning of the next lap creel.

Additionally, the outer radial limit surface of the upper rib portions has a radius which is larger than the radius of the inner radial limit surface of the lower rib portions. Thus, the upper or outer ribs of a lap creel intermesh with the lower or inner ribs of a similarly constructed lap creel, when one is coaxially pushed into the other, whereby the end faces of the inner ribs and of the thread wound on one lap creel push against the end face of a thread wound onto the other lap creel, so that the wound-on thread is compressed when the two creels are coaxially pressed together. The outer ribs of one creel mesh with the inner ribs of the other creel, whereby it is assured that all thread courses are affected by the compression. In other words, it is prevented, that the lowest thread courses or winding layers slip into the annular space formed between the two lap creels in the area where they are inserted into one another. This advantageous effect is achieved even without requiring that the cross-section of the gap between two neighboring ribs matches the cross-sectional shape of the intermeshing rib.

Due to the radial rib dimensions disclosed herein, lap creels of similar construction, according to the invention, may be coaxially inserted into one another in almost any angular orientation with respect to one another, except that the ribs of one creel may not be axially aligned with the ribs of the other creel which would prevent the insertion of one creel into the other. This high degree of angular freedom for stacking or pushing together the lap creels allows large tolerance limits in the exact form of the lap creel, whereby the manufacture and handling of the lap creels is considerably simplified and costs are reduced.

According to the invention, the lower and upper carrying portions can be cylindrical or conical. In the conical embodiment the diameters of the upper and lower portions should become narrower axially inwardly, so that the narrowest diameter is located where the two portions meet. Thus, a bi-conical support surface for the yarn to be wound onto the creel is achieved, whereby an inward axial sliding of yarn is facilitated and an accidental slipping-off of the thread turns from the ends of the creel is hindered. The thread turns wound onto the continuous, essentially closed, contact surface formed by the shell of the lower carrying portion surprisingly exert a considerable retaining force even on the lower or initial thread turns of a lap creel. Thus, even making the upper carrying portion cylindrical will not cause any danger, that the initial thread turns nor even the entire wound-on thread can slip from the creel.

In a preferred embodiment of the invention the upper and lower carrying portions are bridged or connected by a middle carrying zone which tapers conically from the lower to the upper carrying portion, whereby it is possible to construct a lap creel having essentially cylindrical upper and lower carrying portions having differing diameters so as to facilitate the coaxial insertion or stacking of a plurality of similarly constructed lap creels. This difference in diameters is completely bridged or compensated by the conical middle carrying zone.

In the above described construction of a lap creel, the rib portions of the upper and lower carrying portions extend into the middle carrying zone, whereby the radial dimension of the ribs above the corresponding surface of the shell tapers to zero in the middle carrying zone. Thus, depending on the point of view, either each rib penetrates the lap creel shell in the middle carrying zone, or the tapered end of the upper rib portion projecting radially outwardly and the tapered end of the lower rib portion projecting radially inwardly lie directly opposite one another in the middle carrying zone.

In a further embodiment of the invention, a defined limit of the extent to which a lap creel may be coaxially inserted into another lap creel of the same construction is especially advantageously achieved in that the lower rib portions projecting radially inwardly comprise a step in their radially inner limiting surface in the area of the middle carrying zone. Thus an end segment of each lower rib portion comprises a radial limiting or stop surface having a smaller diameter than the outer diameter of the shell of the upper carrying zone. The upper end surface of the shell of an inserted lap creel in this embodiment contacts the step or stop in each of the lower rib portions, whereby the penetration or insertion depth of the first lap creel into the second lap creel is positively limited.

It is practical that the lateral spacing between neighboring ribs is greater than three times the thickness of each rib, whereby an unhindered coaxial insertion of one lap creel into another is possible over an angular range which is at least three times as large as the angular range in which the ribs of two lap creels overlap. Actually, the ratio between the rib thickness and lateral spacing between neigboring ribs may be considerably increased above the ratio 1:3 without detracting from the raking or striking effect of the intermeshing ribs.

BRIEF DESCRIPTION OF THE DRAWINGS

In order that the invention may be clearly understood, it will now be described, by way of example, with reference to the accompanying drawings, wherein.

DETAILED DESCRIPTION OF PREFERED EXAMPLE EMBODIMENTS AND OF THE BEST MODE OF THE INVENTION

Figure 2:
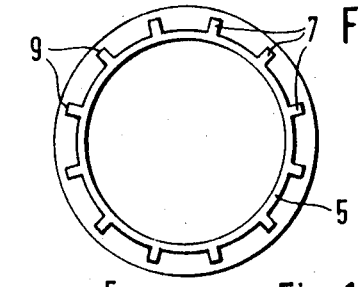
FIG. 2 is a top view onto the lap creel of FIG. 1 with the quarter section cut off in FIG. 1 still shown in FIG. 2.
Figure 1:
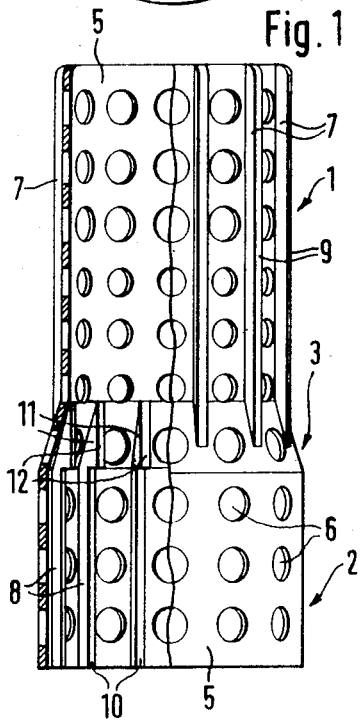
FIG. 1 is a composite view of a lap creel according to the invention with the right hand side shown as a side view and with the left hand side shown as a vertical lengthwise section along section line I—I in FIG. 3.

As shown in FIG. 1, the sleeve-like lap creel essentially comprises an upper thread carrying portion 1, a lower thread carrying portion 2 and a middle thread carrying connecting zone 3. The carrying portions 1, 2 and zone 3 are formed by a continuous shell 5 which is essentially closed and solid, with the exception of radial holes 6 preferably evenly distributed along the length and circumference of the shell 5.

Figure 6:
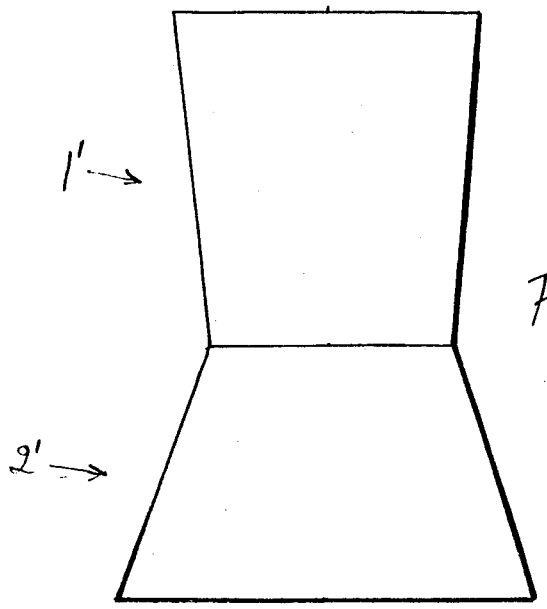
FIG. 6 is a simplified side view of a lap creel according to the invention having conical upper and lower portions.

The upper carrying portion 1 and the lower carrying portion 2 of the shell 5 are cylindrical and the intermediate zone is conically tapered in the direction toward the upper portion. The middle carrying zone 3 forms a connection or transition between the carrying portions 1 and 2 and has a characteristic conical shape. FIG. 6 shows symbolically, the embodiment in which both portions 1' and 2' taper toward each other.

The outer diameter of the upper carrying portion 1 is smaller than the inner diameter of the lower carrying portion 2 so that an upper carrying portion 1 of one creel will fit into the hollow lower carrying portion 2 of another creel.

In the upper carrying portion 1, axially extending upper rib portions 7 are evenly distributed around the circumference of the shell 5 and project radially outwardly from the surface of the shell 5. In the lower carrying portion 2, similarly axially extending lower rib portions 8 are evenly distributed around the inner circumference of the shell 5 so as to project radially inwardly from the inner surface of the shell 5. The rib portions 7 and 8 extend axially from respective opposite ends of the lap creel to the middle conical carrying zone 3 and either taper across the carrying zone 3 or penetrate the carrying zone.

Figure 4:
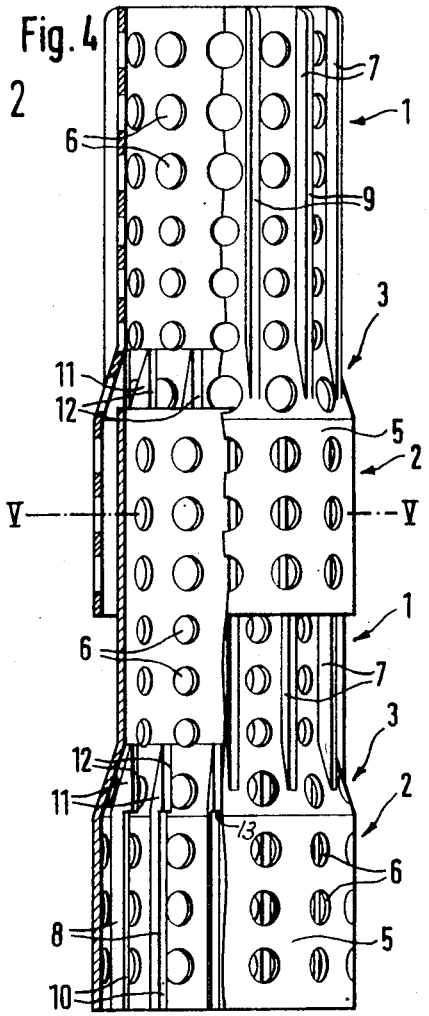
FIG. 4 is a composite view similar to FIG. 1, but of a first lap creel inserted into a second lap creel, shown partially as a side view and partially as a vertical lengthwise section along the line IV—IV of FIG. 5.
Figure 3:
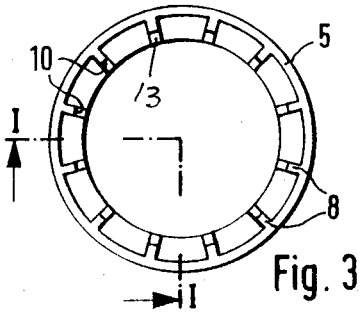
FIG. 3 is a bottom view of the lap creel of FIG. 1 with the quarter section cut off in FIG. 1 shown in FIG. 3.

The upper rib portions or ribs 7 comprise radially outer limiting surfaces 9 having a smaller diameter than the inner diameter of the shell 5 in the lower carrying portion 2. The lower rib portions 8 comprise radially inner limiting surfaces 10 having a larger diameter than the outer diameter of the shell 5 in the upper carrying portion 1. Furthermore, the radially outer limiting surfaces 9 of the upper ribs 7 have a larger diameter than the characteristic diameter of the radially inner limiting surfaces 10 of the lower ribs 8. Thus, the upper ribs 7 of a first lap creel intermesh with the lower ribs 8 of a second lap creel of the same construction when the first creel is coaxially inserted into the second creel as shown in FIG. 4.

Figure 5:
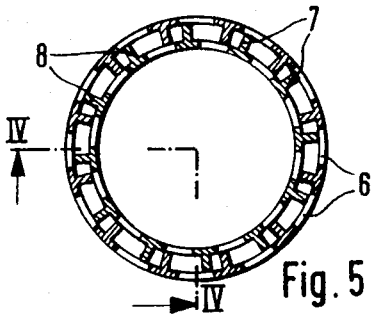
FIG. 5 is a horizontal cross-section along the line V—V through the lap creels of FIG. 4, but showing the quarter sections which are cut off in FIG. 4.

As is shown especially in FIG. 5, large free space gaps exist between neighboring upper ribs 7 of the first lap creel and neighboring lower ribs 8 of the second lap creel. The coaxial stacking or insertion of one creel into another is simplified because the ribs 7 and 8 are not in each other's way due to the wide gaps between neighboring ribs. However, these gaps between neighboring ribs in no way reduce the intermeshing or combing effect of the ribs 7 and 8. As a second creel or upper creel, as seen in FIG. 4, is pushed down coaxially onto a first or lower creel, the downward facing end surface of the upper creel pushes down all thread courses toward the lower carrying portion 2 of the first or lower creel, whereby the thread courses on the lower creel are compacted and all thread courses are evenly compressed, due to the rib intermeshing as described above.

In order to limit the extent to which a first lap creel may be axially inserted into a second lap creel, the upper end segments 11 of the lower ribs 8 each comprise a step-shaped radially inner limit surface 12 having a diameter which is smaller than the outer diameter of the shell 5 in the upper carrying portion 1 of a lap creel.

Figure 7:
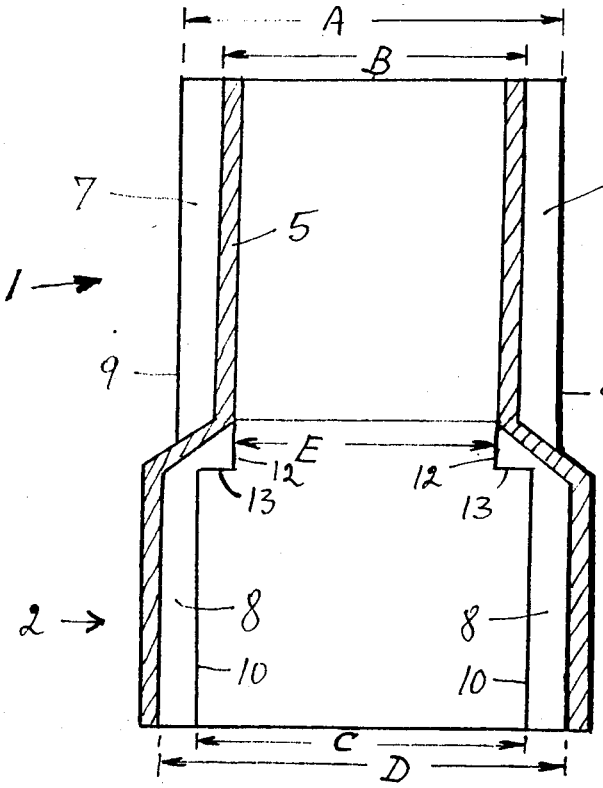
FIG. 7 is an axial sectional view of a lap creel of the invention to illustrate the critical dimensions.

FIG. 7 shows the critical dimensions of a lap creel according to the invention. The upper creel portion 1 has an outer rib diameter A defined by the radially outer surfaces 9 of the upper rib sections 7 and an outer shell diameter B defined by the creel shell 5. The lower creel portion 2 has an inner rib diameter C defined by the radially inner surfaces 10 of the lower rib sections 8, and an inner shell diameter D defined by the bore in the lower portion of the shell 5. The axially downwardly facing stop surfaces 13 form part of the inner ribs 8 and have radially inwardly facing surfaces 12 defining an inner diameter E. The dimensional relationships, which are critical for the above mentioned nesting or stacking, are as follows: $A<D$, $C>B$, $A>C$, and $E<B$. The first two conditions assure the proper nesting. The third condition assures the described rib intermeshing effect. The last condition limits the insertion depth.

Although the invention has been described with reference to specific example embodiments, it will be appreciated, that it is intended to cover all modifications and equivalents within the scope of the appended claims.

What we claim is:

1. A lap creel having a circular circumference, comprising a shell including a thread carrying upper creel portion and a thread carrying lower creel portion, said shell further comprising radial holes said creel further comprising a plurality of axially extending ribs forming channels along said shell, each of said ribs comprising an upper rib section extending lengthwise along the outside of said upper creel portion and a lower rib section extending lengthwise along the inside of said lower creel portion so that said shell intersects each of said ribs between said upper rib section and said lower rib section, said upper rib section having an outer rib diameter (A) and said shell of said upper creel portion having an outer shell diameter (B), said lower rib section having an inner rib diameter (C) and said shell of said lower creel portion having an inner shell diameter (D), said diameters satisfying the following conditions $A<D$ and $C>B$, whereby an upper creel portion fits into a lower creel portion for stacking or nesting a first creel in a second creel.

2. The lap creel of claim 1, wherein said upper and said lower creel portions are each of cylindrical shape.

3. The lap creel of claim 1, wherein said upper creel portion is conically tapered toward said lower creel portion, and wherein said lower creel portion is conically tapered toward said upper creel portion.

4. The lap creel of claim 1, further comprising a middle carrying zone located between and connecting said upper creel portion and said lower creel portion, whereby said middle carrying zone is conically tapered from said lower creel portion to said upper creel portion.

5. The lap creel of claim 4, wherein said upper rib sections extending lengthwise along the outside of said upper creel portion also extend along the outside of said middle carrying zone, and wherein said lower rib sections extending lengthwise along the inside of said lower creel portion also extend along the inside of said middle carrying zone, whereby the radial dimension of said upper and lower rib sections tapers to zero along the axial length of said middle carrying zone.

6. The lap creel of claim 1, wherein each of said lower rib sections of said lower creel portion comprises a step-shaped insertion stop protruding radially inwardly and having an axially facing stop surface, said stop having a diameter (E) which is smaller than said outer shell diameter (B) of said upper creel portion, thus $E<B$ for limiting the insertion depth.

7. The lap creel of claim 1, wherein said ribs have a uniform lateral spacing from one another in a circumferential direction so that all channels have a uniform width in said circumferential direction.

8. The lap creel of claim 7, wherein said uniform lateral spacing between neighboring ribs is equal to or greater than three times the thickness of said ribs.

9. The lap creel of claim 1, wherein said radial holes are uniformly distributed throughout the shell.

10. The lap creel of claim 1, wherein said outer rib diameter (A) of said upper rib sections is larger than said inner rib diameter (C) of said lower rib sections, so that $A>C$, assuring an intermeshing of said upper rib sections of said first creel with said lower rib sections of said second creel.

* * * * *